US011470418B2

(12) United States Patent
Yoon

(10) Patent No.: US 11,470,418 B2
(45) Date of Patent: Oct. 11, 2022

(54) VOICE INPUT APPARATUS

(71) Applicant: LG ELECTRONICS INC., Seoul (KR)

(72) Inventor: Youngsik Yoon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/260,523

(22) PCT Filed: Jul. 12, 2019

(86) PCT No.: PCT/KR2019/008649
§ 371 (c)(1),
(2) Date: Jan. 14, 2021

(87) PCT Pub. No.: WO2021/010498
PCT Pub. Date: Jan. 21, 2021

(65) Prior Publication Data

US 2022/0132238 A1 Apr. 28, 2022

(51) Int. Cl.
*H04R 1/34* (2006.01)
*H04R 1/02* (2006.01)
(Continued)

(52) U.S. Cl.
CPC ..... *H04R 1/345* (2013.01); *H04R 1/025* (2013.01); *H04R 1/04* (2013.01); *H04R 1/08* (2013.01);
(Continued)

(58) Field of Classification Search
CPC ..... H04R 1/345; H04R 1/025; H04R 1/04; H04R 1/08; H04R 1/288; H04R 3/00; H04R 7/12
See application file for complete search history.

(56) References Cited

U.S. PATENT DOCUMENTS

2011/0170728 A1* 7/2011 Chen ..... H04R 1/021 381/365
2019/0211489 A1* 7/2019 An ..... D06F 37/28
2021/0385564 A1* 12/2021 Kim ..... H04R 1/04

FOREIGN PATENT DOCUMENTS

JP 2005244834 A * 9/2005

OTHER PUBLICATIONS

Machine translation of JP2005244834A; Ito, Sep. 2005.*

* cited by examiner

*Primary Examiner* — Andrew L Sniezek
(74) *Attorney, Agent, or Firm* — Lee Hong Degerman Kang & Waimey

(57) ABSTRACT

A voice input apparatus of the present disclosure includes: a panel in which a voice input hole is formed; a circuit board which is disposed below the panel and has a voice passing hole formed in a position corresponding to the voice input hole; a first sealer having a cylindrical shape which is disposed between the panel and the circuit board, an upper end of which is in contact with a bottom surface of the panel while surrounding the voice input hole, and a lower end of which is in contact with an upper surface of the circuit board while surrounding the voice passing hole; a microphone which is disposed below the circuit board and has a sound receiving hole provided in a position corresponding to the sound passing hole; and a second sealer in which an accommodation space having an opening in an upper surface thereof is formed, and the microphone is disposed in the accommodation space, and which is in contact with a bottom surface of the circuit board in a state where the upper surface surrounds the voice passing hole.

10 Claims, 8 Drawing Sheets

(51) Int. Cl.

| | |
|---|---|
| ***H04R 1/04*** | (2006.01) |
| ***H04R 1/08*** | (2006.01) |
| ***H04R 1/28*** | (2006.01) |
| ***H04R 3/00*** | (2006.01) |
| ***H04R 7/12*** | (2006.01) |

(52) U.S. Cl.
CPC ..... *H04R 1/288* (2013.01); *H04R 3/00* (2013.01); *H04R 7/12* (2013.01)

VOICE INPUT APPARATUS

CROSS-REFERENCE TO RELATED APPLICATIONS

This application is the National Stage filing under 35 U.S.C. 371 of International Application No. PCT/KR2019/008649, filed on Jul. 12, 2019, the contents of which is incorporated by reference herein in its entirety.

TECHNICAL FIELD

The present disclosure relates to a voice input apparatus that receives a voice for controlling an appliance.

BACKGROUND ART

There are various appliances, such as TV, air conditioner, audio, cleaner, washing machine, air purifier, clothing manager, refrigerator, oven, dishwasher, water purifier, and dryer, in the home. The appliances are controlled by a wireless communication-based remote control apparatus. In general, a single control apparatus controls a single appliance, but there is an integrated control apparatus that manages and controls several appliances together.

With the development of voice recognition technology, recently, a control apparatus for recognizing a user's voice command and controlling an appliance based on the voice command has been widely used. Such a control apparatus is interoperable with a voice input apparatus that provides a voice-based user interface. The voice input apparatus includes a microphone and a speaker.

The user interface is configured to provide a user with various information such as guidance, response, and notification through the speaker, and to receive various instructions such as selection, execution, inquiry, and control of a menu from the user through the microphone.

In order for the voice recognition-based two-way user interface to operate accurately, the user's voice must be accurately inputted to the microphone, and the sound outputted from the speaker must be accurately transmitted to the user.

However, in the voice input apparatus, in some cases, the sound outputted from the speaker is unintentionally recognized as a control command. For example, when a specific command is inputted through the microphone, the controller activates a voice control mode, and then operates according to a series of voice control commands inputted through the microphone. However, if the sound outputted through the speaker is similar to the specific command, there is a problem that the voice control mode is activated.

In addition, when the output of the speaker and the input through the microphone need to proceed simultaneously—e.g., when it is necessary to recognize the voice through the microphone while music is being played through the speaker—there is a problem that the sound outputted from the speaker interferes with voice recognition.

DISCLOSURE

Technical Problem

The present disclosure has been made in view of the above problems, and a first object of the present disclosure is to provide a voice input apparatus that prevents the sound from entering a microphone through a path other than a voice input hole formed in a panel.

A second object of the present disclosure is to provide a voice input apparatus that prevents the sound transmitted from a speaker room in which a speaker is accommodated from entering a microphone.

A third object of the present disclosure is to provide a voice input apparatus that prevents the sound outputted from the speaker from being unintentionally recognized as a control command.

The objects of the present disclosure are not limited to the above-mentioned objects, and other objects that are not mentioned will be clearly understood by those skilled in the art from the following description.

Technical Solution

In an aspect, there is provided a voice input apparatus including: a panel in which a voice input hole is formed; a circuit board which is disposed below the panel and has a voice passing hole formed in a position corresponding to the voice input hole; a first sealer having a cylindrical shape which is disposed between the panel and the circuit board, an upper end of which is in contact with a bottom surface of the panel while surrounding the voice input hole, and a lower end of which is in contact with an upper surface of the circuit board while surrounding the voice passing hole; a microphone which is disposed below the circuit board and has a sound receiving hole provided in a position corresponding to the sound passing hole; and a second sealer in which an accommodation space having an opening in an upper surface thereof is formed, and the microphone is disposed in the accommodation space, and which is in contact with a bottom surface of the circuit board in a state where the upper surface surrounds the voice passing hole.

The voice input apparatus further includes: a casing which is provided with a speaker room below the microphone; a speaker which is disposed inside the speaker room; a partition which is disposed above the speaker room inside the casing and partitions the inside of the casing vertically; and a third sealer which seals between the partition and an inner surface of the casing.

The second sealer has an opening formed in a lower surface, and the lower surface is in contact with an upper surface of the partition.

The voice input apparatus further includes: a power supply unit which supplies power to the speaker, and is fixed to the partition; and a third sealer which seals between the partition and the inner surface of the casing.

The voice input apparatus further includes: a sound insulation board which is fixed between the speaker room and the partition; and a fourth sealer which seals between the sound insulation board and the inner surface of the casing.

The speaker room includes: a room base which is disposed below the speaker; and a room sidewall which has an opened upper surface, is extended upward from a circumference of the room base to surround the speaker, and has a sound discharge port communicating the inside and the outside of the speaker room.

The room side wall has an opened upper surface, and the speaker room further comprises a room ceiling covering the opened upper surface of the room sidewall.

The speaker comprises a diaphragm that emits sound downward, and the room base is disposed below the diaphragm.

The voice input apparatus further includes: a sound guide which is protruded upward from the room base, positioned below the diaphragm, and reflects the sound outputted from the diaphragm outward in a radial direction.

The sound guide has a cone shape which protrudes from the room base.

The speaker room further includes an inclined surface which is disposed in an upper side of the diaphragm and, when viewed from above, is extended in a circumferential direction while surrounding a circumference of the speaker, and is gradually lowered as it progresses toward the outside in a radial direction.

Advantageous Effects

A voice input apparatus according to the present disclosure has the following effects.

First, a transmission path of voice is formed in such a manner that a voice command of a user passes through a voice input hole formed in a panel and a voice passing hole formed in a circuit board sequentially to reach a microphone, and the transmission path is sealed by a first sealer disposed between the panel and the circuit board and a second sealer disposed below the circuit board, so that noise can be prevented from penetrating into the transmission path, thereby a correct voice command can be entered to the microphone.

Second, the sound transmitted from the speaker room in which the speaker is accommodated is blocked by at least one sealer disposed in the casing, thereby preventing the sound from being transmitted to the microphone. Accordingly, the problem that the sound outputted from the speaker is unintentionally recognized as a control command does not occur.

The effects of the present disclosure are not limited to the effects mentioned above, and other effects not mentioned can be clearly understood by those skilled in the art from the description of the claims.

MODE FOR DISCLOSURE

Figure 1:
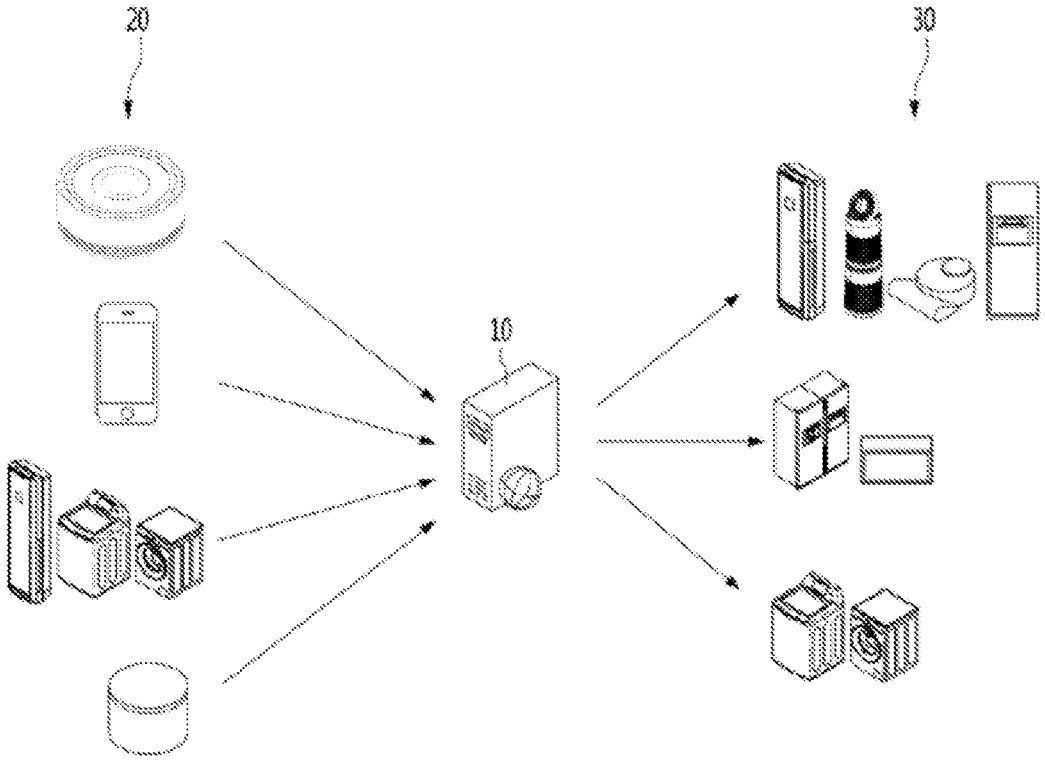
FIG. 1 is a conceptual diagram of an appliance control system according to an embodiment of the present disclosure.

Hereinafter, preferred embodiments of the present disclosure will be described with reference to the accompanying drawings. In describing the present embodiment, the same designations and the same reference numerals are used for the same components, and further description thereof will be omitted.

FIG. 1 is a conceptual diagram of an appliance control system according to an embodiment of the present disclosure. Referring to FIG. 1, the appliance control system may include an appliance control apparatus 10, at least one voice input apparatus 20, and at least one appliance 30. The appliance 30 is not limited to a home appliance used at home, and may be an office appliance used in a work space.

The appliance control apparatus 10 may receive various types of control commands from the voice input apparatus 20, and transmit a control signal based on the received control command to the appliance 30.

The appliance 30 may include a communication module for communication connection with the appliance control apparatus 10. For example, the appliance 30 may include a wireless internet module such as Wi-Fi.

The appliance control apparatus 10 may receive information on an event generated in the appliance 30, and notify the received information to the user through the voice input apparatus 20. That is, the appliance control apparatus 10 may serve as a hub or a server. Specific configuration and operation of the appliance control apparatus 10 will be described in more detail later.

The voice input apparatus 20 may receive a control command for controlling the appliance 30 from the user, and transmit the received control command to the appliance control apparatus 10. The control command may be in the form of a voice, and the voice input apparatus 20 may include a microphone 221 (see FIG. 4) for receiving a voice. The voice input apparatus 20 may receive a control command through a touch or a button in addition to voice.

In addition, the voice input apparatus 20 may include an output means such as a speaker 231, a display 232, or the like. Accordingly, the voice input apparatus 20 may output a processing result or response according to the inputted control command, or may output information or data received from the appliance control apparatus 10. The information or data may be related to various events generated in the appliance 30.

The voice input apparatus 20 may be a mobile terminal such as smartphone and tablet PC, an audio output device (e.g., an artificial intelligence speaker) having a built-in input means such as a microphone, and an appliance (e.g., air conditioner, washing machine, or the like that are equipped with a microphone) having the built-in input means.

Figure 2:
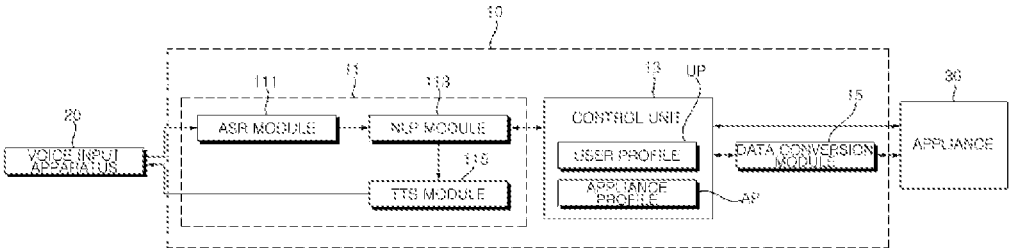
FIG. 2 is a schematic block diagram of an appliance control apparatus according to an embodiment of the present disclosure.

FIG. 2 is a schematic block diagram of an appliance control apparatus according to an embodiment of the present disclosure. Referring to FIG. 2, the appliance control apparatus 10*a* may include a voice processing unit 11 and a control unit 13. Each of the voice processing unit 11 and the control unit 13 may be implemented in a separate server form or may be integrated in a single server.

A user's voice (or voice command) inputted through the voice input apparatus 20 may be transmitted to the voice processing unit 11. The voice may include a control command for a specific appliance.

The voice processing unit 11 may process the received voice, convert the received voice into text, and acquire a control command for a specific appliance from the converted text. The voice processing unit 11 may transmit the acquired control command to the control unit 13.

Furthermore, the voice processing unit 11 may convert a message or various information in the form of text or code transmitted from the control unit 13 into a voice form, and transmit the converted voice form guide message or various information to the voice input apparatus 20.

In detail, the voice processing unit 11 may include an automatic speech recognition (ASR) module 111, a natural language processing (NLP) module 113, and a text to speech (TTS) module 115. The ASR module 111, the NLP module 113, and the TTS module 115 may be implemented in a single server, or may be implemented in separate servers respectively.

The ASR module 111 may convert a voice transmitted from the voice input apparatus 20 into text by using a known automatic speech recognition technology.

The NLP module 113 may check (analyze) whether a control command that can be processed by the control unit 13 or the appliance 30 is contained from the converted text. For example, the NLP module 113 may acquire a keyword for identifying the appliance 30 and/or a keyword related to the function or operation of the appliance 30 from the natural language corresponding to the converted text. The NLP module 113 may check the control command based on the acquired keyword.

Alternatively, the NLP module 113 may generate text in a natural language form containing the message or information based on the message or information transmitted from the control unit 13, and transmit the generated text to the TTS module 115.

The TTS module 115 may convert the text transmitted from the NLP module 113 into voice, and transmit the converted voice to the voice input apparatus 20.

The control unit 13 may receive a control command for the appliance 30 from the voice processing unit 11, and generate a control signal corresponding to the received control command. The control unit 13 may transmit the generated control signal to the appliance 30.

Meanwhile, the control unit 13 may generate the control signal based on a user profile UP and an appliance profile AP.

The user profile UP may include information related to appliances possessed by the user of the voice input apparatus 20. According to an embodiment, the user profile UP may further include various information such as product information (model information) of the appliances possessed by the user, a driving history, a usage pattern, an error history, a repair history, and the like for each of the possessed appliances.

According to an embodiment, the appliances possessed by the user are grouped based on a reference such as space or function, and only a representative appliance of each group may be directly connected to the control unit 13. For example, when an air cleaner among the appliances located in the living room is provided with only a short range communication module and cannot be directly connected to the control unit 13, the air cleaner may be connected to the control unit 13 through an air conditioner. In this case, among the appliances located in the living room, the air conditioner may correspond to the representative appliance.

The control unit 13 may control the remaining appliances through the representative appliance. To this end, the user profile UP may further include group information of the appliances, representative appliance information, and/or connection information between the appliances.

The appliance profile (AP) may include information related to the functions (modes) supported by each of the products (models) of the appliance, a data format (e.g., code information) for each of the functions, and the like.

The control unit 13 may generate the control signal based on the control command, the user profile UP, and the appliance profile AP. For example, when the control command includes a command for driving the air conditioner in a dehumidification mode, the control unit 13 may acquire product information (model information) of the air conditioner possessed by the user from the user profile UP. In addition, the control unit 13 may acquire code information related to the dehumidification mode of the model of the air conditioner possessed by the user from the appliance profile AP. The control unit 13 may generate a control signal for driving the dehumidification mode of the air conditioner by using the acquired code information. The control unit 13 transmits the generated control signal to the air conditioner, and the air conditioner may activate the dehumidification mode in response to the received control signal.

Meanwhile, in the appliance 30, the code information for a specific function may be different according to a detailed model. That is, the code information may be fragmented according to the model. In this case, in order for the control unit 13 to generate a control signal based on the control command, an additional process of acquiring code information for each of the models may be necessary. Since the control unit 13 generates a control signal by processing each of a plurality of control commands received from each of the plurality of users, the additional process may cause an increase in load of the control unit 13 and a delay in processing speed.

Accordingly, the appliance control apparatus 10 may further include a data conversion module 15 that performs an operation of generating a control signal having code information related to the model of a target appliance (or a control target appliance). The data conversion module 15 may be implemented as a separate server from the control unit 13, or may be implemented as a server together with the control unit 13. Alternatively, the data conversion module 15 may be implemented in a separate configuration from the appliance control apparatus 10. According to an embodiment, a plurality of data conversion modules 15 may be implemented, and each data conversion module 15 may be connected to the control unit 13.

When the data conversion module 15 exists, the control unit 13 may generate a control signal including integrated code information on a function to be controlled in the appliance based on the control command. The integrated code information may mean code information that is commonly set for a specific appliance product group.

The data conversion module 15 may convert the integrated code information included in the control signal into code information related to a model of the target appliance. To this end, the appliance profile AP may be provided in the data conversion module 15. In this case, the control unit 13 may transmit the model information of the target appliance along with the control signal to the data conversion module 15. The data conversion module 15 may convert the code information of the control signal based on the model information received from the control unit 13.

The data conversion module 15 may be implemented as a platform such as a kind of cloudlet assisting the control server 13. The data conversion module 15 may distribute the load of the control unit 13 through the above-described operation. Accordingly, the load of the control unit 13 may be effectively reduced, and the delay of the processing speed may be minimized.

Hereinafter, the configuration of the control unit 13 according to an embodiment of the present disclosure will be described with reference to FIG. 3.

Figure 3:
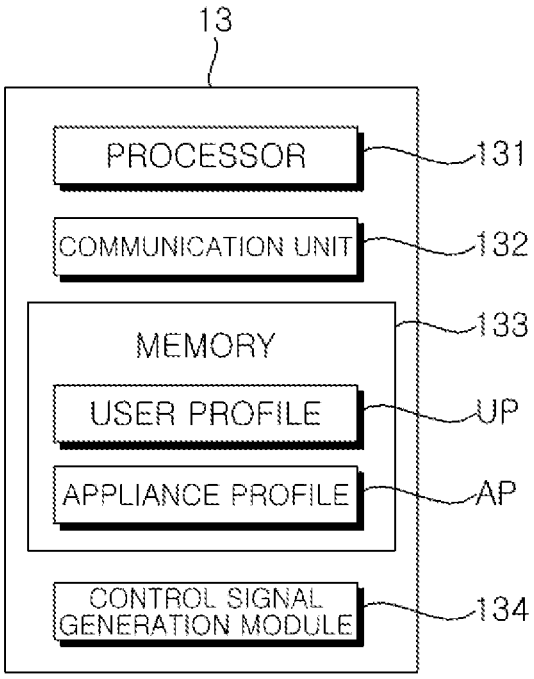
FIG. 3 is a schematic block diagram of the control apparatus shown in FIG. 2.

FIG. 3 is a schematic block diagram of the control apparatus shown in FIG. 2. Referring to FIG. 3, the control unit 13 may include a processor 131, a communication unit 132, a memory 133, and a control signal generation module 134.

The processor 131 may control the overall operation of the control unit 13. The processor 131 may receive a control command for the appliance 30 from the voice processing unit 11 through the communication unit 132. The processor 131 may control the control signal generation module 134 to generate a control signal based on the received control command. The processor 131 may transmit the generated control signal to the appliance 30 through the communication unit 132. To this end, the communication unit 132 may include at least one communication module such as an internet module, a mobile communication module, and the like.

According to an embodiment, the processor 131 may receive a response according to the control signal from the appliance 30 through the communication unit 132, or receive operation information or state information of the appliance 30. The processor 131 may transmit the received response, operation information, or state information to the voice processing unit 11 or the voice input apparatus 20. Alternatively, the processor 131 may control the control signal generation module 134 to generate a control signal based on the received response, operation information, or state information. The processor 131 may transmit the generated control signal to the appliance 30 through the communication unit 132.

The processor 131 may include at least one central processing unit (CPU), application processor (AP), integrated circuit, microcontroller, electrical unit for performing other functions, or the like.

The memory 133 may store various information, data, and algorithm for the operation of the control unit 13. The memory 133 may include a nonvolatile memory and a volatile memory. The nonvolatile memory may store the various information, data, and algorithm, and the volatile memory may temporarily store data acquired during the operation of the control unit 13 or information, data, algorithm, or the like loaded from the nonvolatile memory.

In particular, the memory 133 may store a user profile UP and an appliance profile AP. The user profile UP and the appliance profile AP may include information necessary for the control signal generation module 134 to generate a control signal for the target appliance.

As described above with reference to FIG. 2, the user profile UP may include information related to appliances possessed by a user of the voice input apparatus 20. According to an embodiment, the user profile UP may further include various information such as product information (model information) of appliances possessed by the user, a driving history, a usage pattern, an error history, a repair history, and the like for each of the possessed appliances.

The appliance profile (AP) may include information on the functions (modes) supported by each of the products (models) of the appliance, a data format (e.g., code information) for each of the functions, and the like.

According to an embodiment, when the control unit 13 is connected to a separate database device, the user profile UP and the appliance profile AP may be provided in the database device. The processor 131 may receive at least a portion of the user profile UP or at least a portion of the appliance profile AP from the database device and store it in the memory 133.

The control signal generation module 134 may generate a control signal corresponding to the control command received from the voice processing server 11 or the voice input apparatus 20. In FIG. 3, it is illustrated that the control signal generation module 134 is a separate configuration from the processor 131, but according to an embodiment, the control signal generation module 134 may be a configuration included in the processor 131.

The control signal generation module 134 may acquire model information of the appliance to be controlled according to the control command among the appliances possessed by the user from the user profile UP. In addition, the control signal generation module 134 may acquire data (e.g., code information) corresponding to a function to be performed according to the control command, from among data related to the model of the appliance to be controlled, from the appliance profile AP. The control signal generation module 134 may generate a control signal including the acquired data (code information).

According to an embodiment, when the appliance control apparatus 10 includes the data conversion module 15, the control signal generation module 134 may generate a control signal including integrated code information related to a function to be performed according to the control command. The data conversion module 15 may convert the integrated code information into code information corresponding to the model of the appliance to be controlled.

Hereinafter, a voice input apparatus according to an embodiment of the present disclosure will be described with reference to FIGS. 4 to 5.

Figure 4:
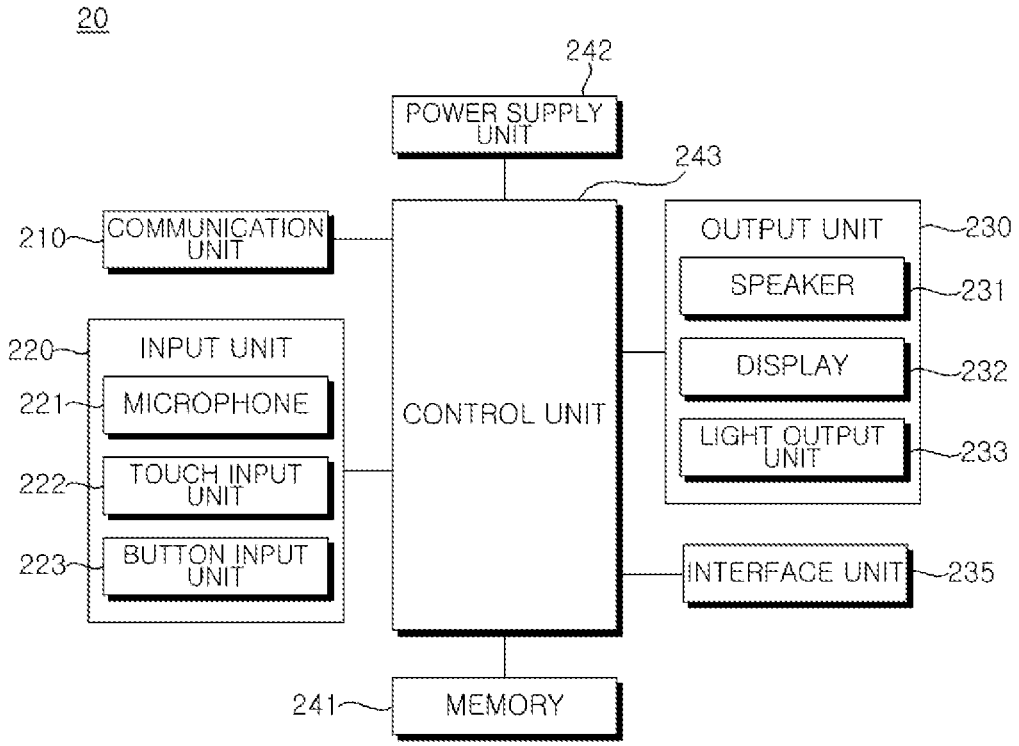
FIG. 4 is a schematic block diagram of a voice input apparatus shown in FIG. 1.

FIG. 4 is a schematic block diagram of a voice input apparatus shown in FIG. 1. Referring to FIG. 4, the voice input apparatus 20 may include a communication unit 210, an input unit 220, an output unit 230, a memory 241, a control unit 243, a power supply unit 242, and an interface unit 235.

The communication unit 210 may include at least one communication module for connecting the voice input apparatus 20 to the appliance control apparatus 10, the voice processing unit 11, the control unit 13, the appliance 30, and/or a user terminal through a network. For example, the communication unit 210 may include a short range communication module such as a Bluetooth and a near field communication (NFC), a wireless Internet module such as Wi-Fi, or a mobile communication module. The controller 243 may transmit a control command to the appliance control apparatus 10, particularly, the voice processing unit 11 or the control unit 13, or transmit a control signal to the appliance 30 through the communication unit 210. In addition, the controller 243 may receive information or data related to the appliance 30 from the voice processing unit 11 or the control unit 13, or may receive information or data from the appliance 30 through the communication unit 210.

The input unit 220 may include input means for inputting a certain signal, information, and/or data to the voice input apparatus 20 by an action such as a user's operation. The input unit 220 may include a microphone 221. In some embodiments, the input unit 220 may include a touch input unit 222 through which a command is inputted through a user's touch operation and/or a button input unit 223 through which a command is inputted through a button manipulation.

The user may control the operation of the voice input apparatus 20 through the button input unit 223. The button input unit 223 may be a button for acquiring a voice including a control command of the appliance 30 from the user. In other words, the button input unit 223 may correspond to a button for activating/deactivating the microphone 221.

For example, after the user presses the button input unit 223 or during pressing, the controller 243 may activate the microphone 221 to acquire a voice uttered by the user. After completing the uttering of the voice, the user may press the button input unit 223 again, or terminate the pressing operation. In this case, the controller 243 may deactivate the microphone 221, and transmit the received voice to the voice processing unit 11.

The user may input a control command for controlling the target appliance through the input unit 220. The user may input a control command in the form of a voice through the microphone 221. Alternatively, the user may input a control command in a text form through the touch input unit 222 or the button input unit 223, or by selecting a menu or icon outputted through the display 232.

The output unit 230 may output information related to an operation or a state of the voice input apparatus 20. According to an embodiment, the output unit 230 may output information or data received from the appliance control apparatus 10. For example, the information or data received from the appliance control apparatus 10 may include information related to the operation or state of the appliance 30, a response or a processing result for the control command inputted through the input unit 220, and the like.

The output unit 230 may include at least one of a speaker 231 for outputting various information or data in the form of voice or sound, a display 232 for outputting the various information or data in the form of text or graphic, and a light output unit 233 for outputting the various information or data through the color or brightness of light, a light emitting pattern, or the like.

The memory 241 may store various data such as control data for controlling operations of components included in the voice input apparatus 20 and data for performing an operation corresponding to an input acquired through the input unit 220.

The controller 243 may control the overall operation of the voice input apparatus 20. In particular, the controller 243 may control the input unit 220 to acquire a control command for the appliance 30 from the user. The controller 243 may transmit the acquired control command to the appliance control apparatus 10 through the communication unit 210. In addition, the controller 243 may receive various information or data from the appliance control apparatus 10 through the communication unit 210, and control the output unit 230 to output the received information or data.

The controller 243 may include hardware such as at least one CPU, microcomputer, AP, or the like.

The power supply unit 242 may supply power required for the operation of each of the components included in the voice input apparatus 20. For example, the power supply unit 242 may correspond to an apparatus which is connected to an external power source and supplies power provided from the power source to the components.

According to an embodiment, the power supply unit 242 may include a battery. The battery may be provided in the voice input apparatus 20, and may be connected to an external power source through a power connection terminal included in the voice input apparatus 20 to be charged. The voice input apparatus 20 equipped with the battery may be implemented as a portable type device that is movable by a user in a specific space.

The power supply unit 242 may further include a wireless power receiver (e.g., a coil) for wirelessly receiving power from the outside. In this case, the voice input apparatus 20 may be seated, attached, or mounted in close proximity to the appliance 30 having a wireless power transmitter or a wireless power charging device, and may receive power from the wireless power transmitter. According to an embodiment, depending on a wireless power transmission method implemented in the power supply unit 242, the voice input apparatus 20 may receive power even in a state of being spaced apart from the wireless power transmitter. The power supply unit 242 may charge the battery by using the supplied power.

The interface unit 235 may provide an interface for connecting the voice input apparatus 20 to other device. The interface unit 235 may provide an interface for a wired connection such as a universal serial bus USB.

The voice input apparatus 20 may be connected to the appliance 30 through the interface unit 235. The appliance 30 may be an appliance having no communication module, but is not limited thereto. That is, the appliance 30 having no communication module may transmit/receive a signal or data with the appliance control apparatus 10 through the voice input apparatus 20.

According to an embodiment, the voice input apparatus 20 may receive power from the appliance 30 through the interface unit 235.

Figure 5:
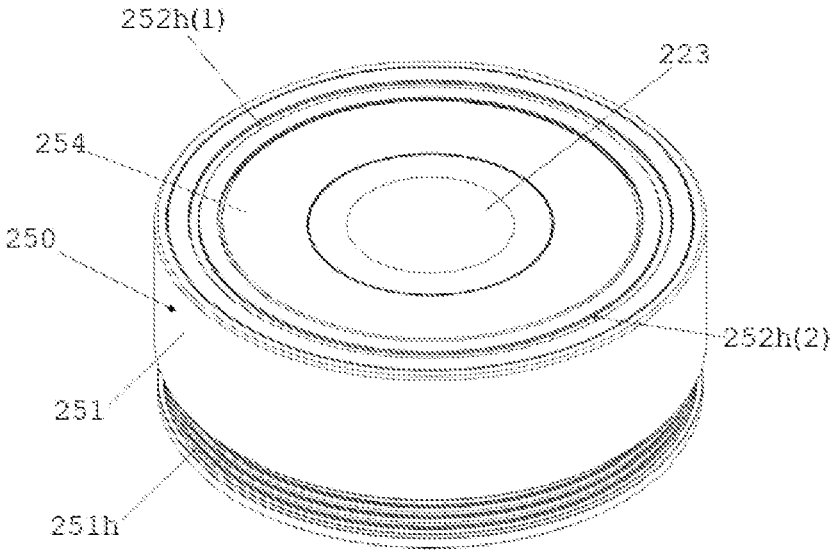
FIG. 5 is a perspective view of a voice input apparatus according to an embodiment of the present disclosure.
Figure 6:
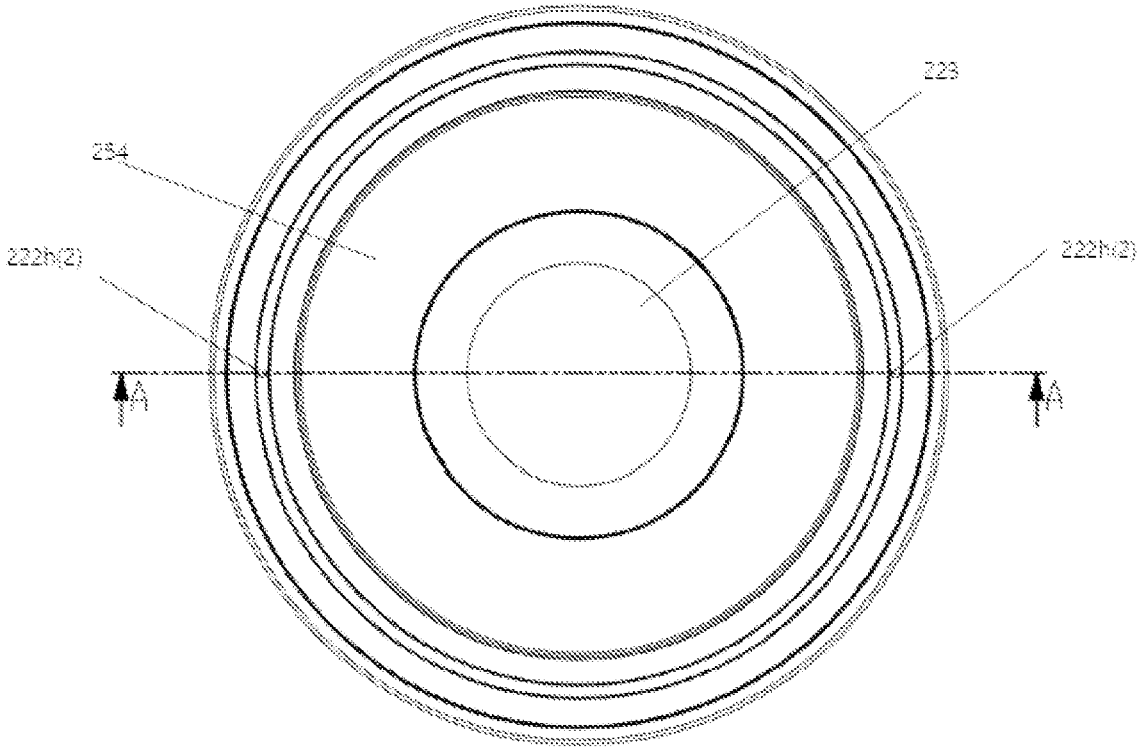
FIG. 6 is a plan view of the voice input apparatus shown in FIG. 5.
Figure 7:
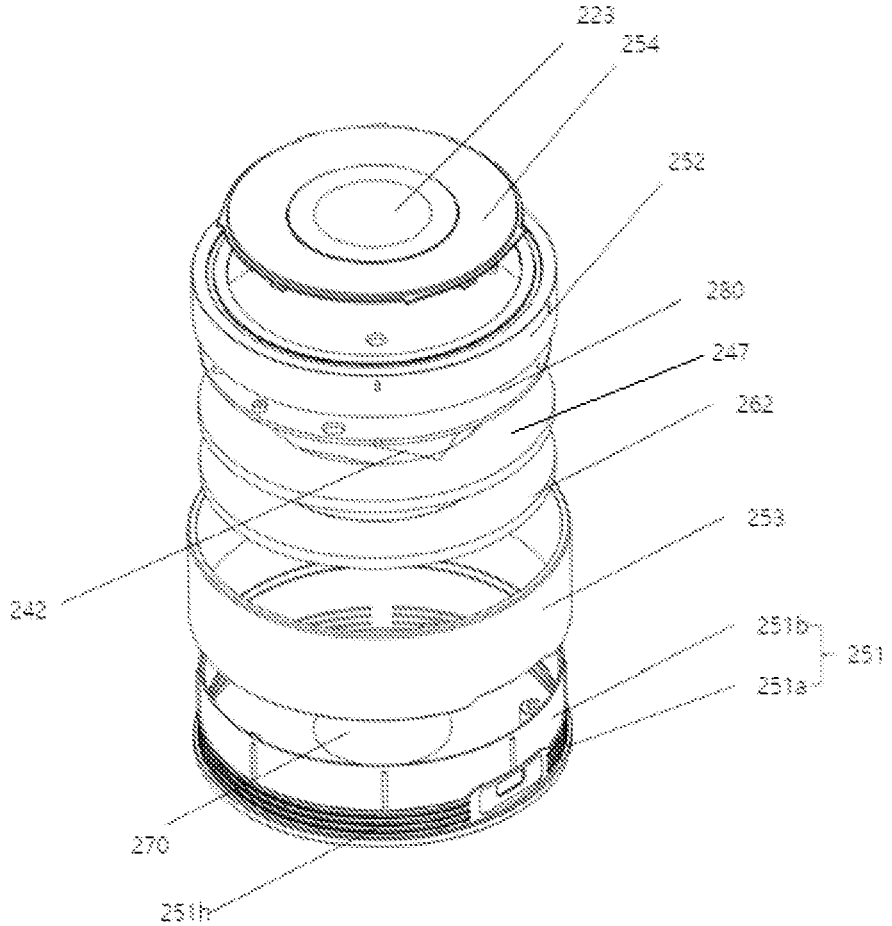
FIG. 7 is an exploded perspective view of a voice input apparatus.
Figure 8:
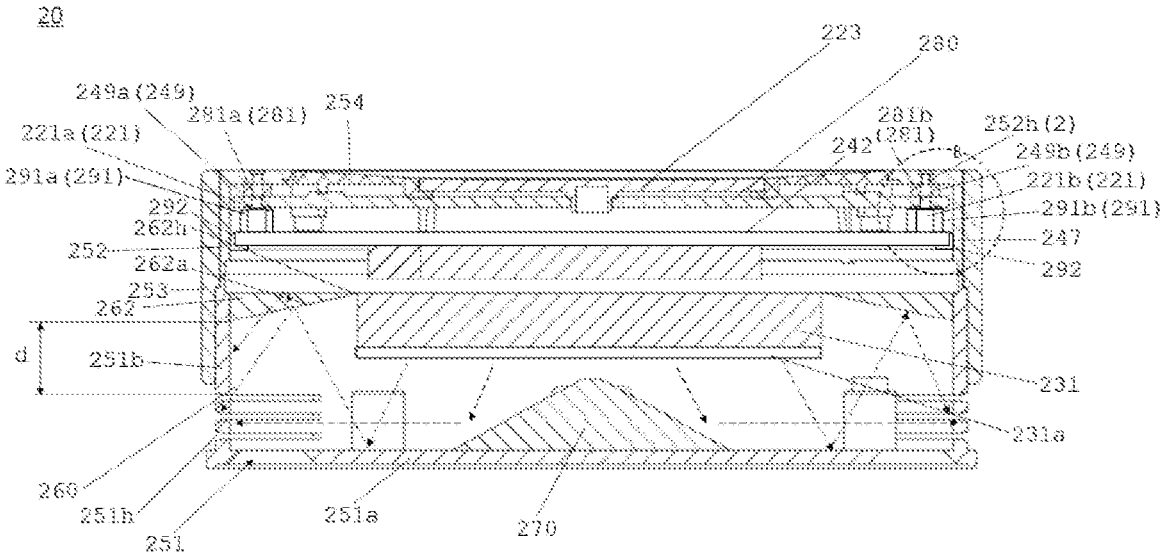
FIG. 8 is a cross-sectional view taken along line A-A of FIG. 6.
Figure 9:
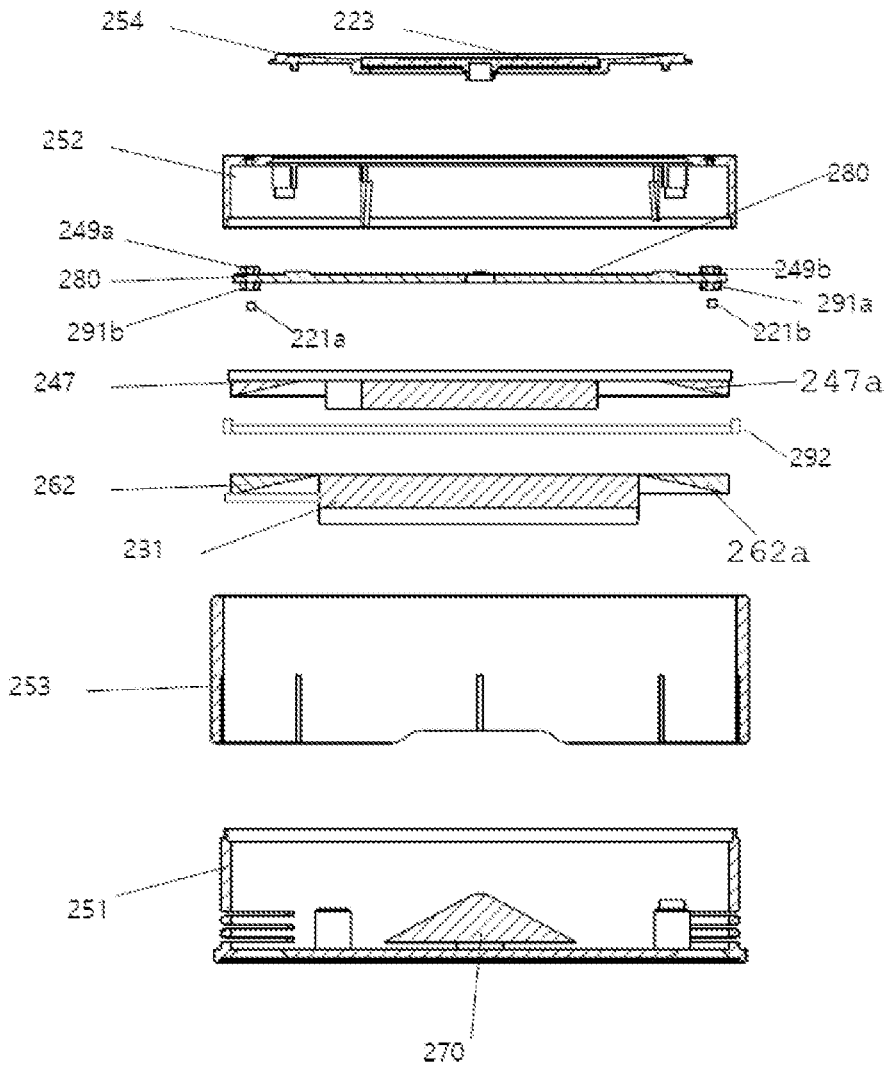
FIG. 9 is an exploded view of components in the cross-sectional view shown in FIG. 8.
Figure 10:
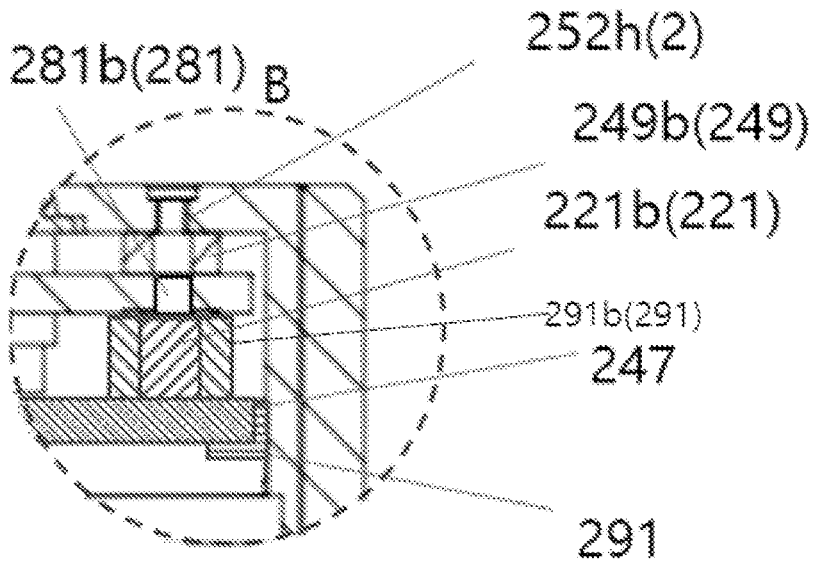
FIG. 10 is an enlarged view of a portion denoted by B in FIG. 8.

FIG. 5 is a perspective view of a voice input apparatus according to an embodiment of the present disclosure. FIG. 6 is a plan view of the voice input apparatus shown in FIG. 5. FIG. 7 is an exploded perspective view of a voice input apparatus. FIG. 8 is a cross-sectional view taken along line A-A of FIG. 6. FIG. 9 is an exploded view of components in the cross-sectional view shown in FIG. 8. FIG. 10 is an enlarged view of a portion denoted by B in FIG. 8.

Referring to FIGS. 5 to 10, the voice input apparatus 20 may be disposed in a position desired by a user in a specific space (e.g., a home), and receive a control command in the form of a voice from the user. In other words, the disposition position of the voice input apparatus 20 may be freely changed by the user.

The voice input apparatus 20 includes a speaker 231, a speaker room 260 in which the speaker 231 is accommodated, and at least one microphone 221 disposed outside the speaker room 260.

The speaker 231 outputs sound downward. The speaker 231 includes a diaphragm 231*a* that vibrates according to an electric signal and emits sound, and the sound by the diaphragm 231*a* is outputted downward.

The speaker room 260 receives at least a portion of the speaker 231. Preferably, the diaphragm 231*a* is disposed in the speaker room 260 so that the sound emitted from the diaphragm 231*a* is transmitted into the speaker room 260. The speaker room 260 may serve as a soundbox to resonate sound.

The voice input apparatus 20 may include a casing 250 forming an outer shape. At least a portion of the casing 250 may constitute the speaker room 260. The casing 250 may include a casing body 251, a casing cover 252, a side panel 253, and/or an upper panel 254.

The casing body 251 may be formed in a substantially cylindrical shape, and the upper surface may be opened and the lower surface may be closed. At least a portion of the speaker room 260 may be formed in the casing body 251.

The speaker room 260 may include a room base 251*a*, a sound guide 270, and a room sidewall 251*b*. The room base 251*a* is disposed below the diaphragm 231 and may be substantially horizontal. The room base 251*a* may constitute the bottom of the casing body 251.

The sound guide 270 reflects the sound emitted from the speaker 231 to the outside along the lateral direction or the radial direction. The sound reflected by the sound guide 270 may be emitted to the outside of the voice input apparatus 20 through a sound discharge port 251*h* positioned around the sound guide 270.

The sound guide 270 may protrude upward from the room base 251*a* and be positioned below the diaphragm 231*a*. The sound outputted from the diaphragm 231*a* may be reflected outward along the radial direction by the sound guide 270. The sound guide 270 may have a conical shape (e.g., a cone or a truncated cone) whose cross-sectional area becomes narrower as it progresses toward the upper side. Preferably, the sound guide 270 may be implemented in the form of a cone or a truncated cone so that the sound is uniformly reflected by 360 degrees.

In an embodiment, the sound guide 270 is configured separately from the room base 251*a* and is coupled with the room base 251*a*, but not necessarily limited thereto, and can be formed integrally with the room base 251*a* (or a single component).

Meanwhile, the room sidewall 251*b* is extended upward from the circumference of the room base 251*a* and surrounds the sound guide 270. The room sidewall 251*b* is provided with the sound discharge port 251*h* for emitting the sound reflected by the sound guide 270 to the outside of the speaker room 260. The inside and the outside of the speaker room 260 communicate with each other through the sound discharge port 251*h*.

The room sidewall 251*b* may be extended from the room base 251*a* to a height higher than the diaphragm 231*a*. The room sidewall 251*b* may be a cylindrical shape having an upper surface and a lower surface that are opened, the opened lower surface may be closed by the room base 251*a*, and the upper surface may be covered by a room ceiling 262 described later. The speaker 231 may be fixed to the room ceiling 262.

The sound discharge port 251*h* may be formed long in the circumferential direction. In other words, the sound discharge port 251*h* may have a length longer than the width in the vertical direction. A plurality of sound discharge ports 251*h* formed in parallel with each other may be disposed to be spaced apart from each other in the vertical direction. The plurality of sound discharge ports 251*h* may be spaced apart along the circumferential direction.

Meanwhile, the speaker room 260 may include an inclined surface 262*a* disposed above the diaphragm 231*a*. The inclined surface 262*a* is extended in the circumferential direction while surrounding the circumference of the speaker 231 (or the diaphragm 231*a*) when viewed vertically downward from above, and may be gradually lowered as it progresses toward the outside along the radial direction.

When viewed from above (hereinafter, 'when viewed from above' means a case of viewing downward vertically), the inclined surface 262*a* may have a shape of surrounding the sound guide 270. The inclined surface 262*a* roughly faces the truncated cone. The sound that is emitted from the diaphragm 231*a* and is reflected by the room base 251*a* or the sound guide 270 and then reached the inclined surface 262*a* may be reflected by the inclined surface 262*a* to reach the sound discharge port 251*h*.

In particular, in a structure in which the sound discharge port 251*h* is spaced apart from the inclined surface 262*a* downward by a certain distance d in the radial direction from the outside of the inclined surface 262*a*, the inclined surface 262*a* faces the inner side in the radial direction, thereby reducing the sound waves that are reflected by the inclined surface 262*a* and incident into the spaced section d. For reference, the arrow indicated by a two-dot chain line in FIG. 8 shows that the sound reflected from the room base 251*a* is incident into the spaced section d when reflected by a virtual horizontal plane, the arrow indicated by a dashed dotted line shows that the sound reflected by the inclined surface 262*a* is incident into the sound discharge port 251*h*, and the arrow indicated by the dotted line shows the sound which is reflected by the sound guide 270 and proceeds directly to the sound discharge port 251*h*.

Meanwhile, the speaker room 260 may further include a room ceiling that covers the opened upper surface of the room sidewall 251*b*. The room ceiling 262 may close at least a portion of the opened upper surface of the room sidewall 251*b*. The inclined surface 262*a* may be formed in the bottom surface of the room ceiling 262.

An opening 262*h* may be formed in the room ceiling 262. The inclined surface 262*a* may be extended along the circumference of the opening 262*h* to form an annular shape. The speaker 231 may be disposed inside the opening 262*h*, and in this case, the room ceiling 262 may be a sound insulation board or a soundproof board that blocks sound from leaking upward from the speaker room 260.

Meanwhile, the microphone 221 may be disposed above the speaker room 260. The casing cover 252 may be disposed above the casing body 251. The casing cover 252 is formed in a cylindrical shape having an upper surface and a lower surface that are opened respectively such that the microphone 221, the power supply unit 242, the circuit board 280, and/or a partition 247 may be disposed inside the casing cover 252.

A control command in the form of a voice may be received through the microphone 221. A plurality of microphones 221 may be provided. Preferably, as in the embodiment, two microphones 221*a* and 221*b* are spaced apart from each other at a certain interval.

At least one voice passing hole 281 is formed in the circuit board 280. Two voice passing holes 281*a* and 281*b* may be formed to correspond to the two microphones 221*a* and 221*b*, respectively.

Each of the microphones 221*a* and 22*b* may be disposed in the bottom surface of the circuit board 280. Here, the bottom surface of the circuit board 280 may be a surface facing the speaker room 260. The microphone 221 may be disposed in an area where a voice receiving hole (not shown) for receiving a sound is overlapped with the voice passing hole 281. That is, when viewed from above, at least a portion of the voice receiving hole may be overlapped with the voice passing hole 281.

A second sealer 291 having an accommodation space in which the microphone 221 is accommodated may be further provided. Two second sealers 291*a* and 291*b* may be provided to correspond to the two microphones 221*a* and 221*b*, respectively.

The second sealer 291 has an opening for opening the accommodation space formed in an upper surface thereof. The microphone 221 is accommodated in the accommodation space through the opening. The opened upper surface of the second sealer 291 may be in contact with the bottom surface of the circuit board 280 in a state of surrounding the voice passing hole 281. The second sealer 291 may be formed of a soft material.

An opening is formed in a lower surface of the second sealer 291, and the lower surface may contact the upper surface of the partition 247. The partition 247 may serve to support and fix the second sealer 291 as well as to seal the accommodation space.

In the embodiment, the second sealer 291 is formed in a cylindrical shape in which both the upper and lower surfaces thereof are opened. However, it is not necessarily limited thereto, and may have a structure where the lower surface is closed.

At least a portion of the casing cover 252 may cover the upper side of the circuit board 280. In the casing cover 252, a voice input hole 252*h* may be formed in an area overlapping with the voice passing hole 281 when viewed from the above. Two voice input holes 252*h* may be formed to correspond to the two voice passing holes 281, respectively.

In detail, the casing cover 252 may include a cylindrical cover sidewall 252*a* and a cover upper surface portion 252*b* formed in an upper end of the cover sidewall 252*a*. The two voice input holes 252*h* may be formed in the cover upper surface portion 252*b*.

A pair of first sealers 249 forming a path may be provided between the cover upper surface portion 252*b* and the circuit board 280 so that the sound inputted through the voice input hole 252*h* is not leaked but guided to the voice passing hole 281. The first sealer 249 may be made of a soft material.

Each of the first sealers 249*a* and 249*b* is formed in a cylindrical shape having a hollow through which sound passes, and an upper end may be in close contact with the bottom surface of the cover upper surface portion 252*b*, and a lower end may be in close contact with the upper surface of the circuit board 280. The opened upper end of the first sealer 249*a* may surround the voice input hole 252*h*, and the opened lower end of the first sealer 249*a*, 249*b* may surround the circumference of the voice passing hole 281*a*, 281*b*.

The partition 247 may be disposed above the speaker room 260 and may partition the inside of the casing 250 vertically. The partition 247 may be disposed inside the casing cover 252. The partition 247 may be disposed below the circuit board 280.

A third sealer 292 may be provided to seal between the partition 247 and the inner surface of the casing 250 (or the inner surface of the casing cover 252). The third sealer 292 may have an annular shape and be made of soft material to surround the partition 247. At least a portion of the third sealer 292 may be interposed between the partition 247 and the inner surface of the casing cover 252. The sound transmitted from the speaker room 260 may be blocked by the third sealer 292, so that it can be prevented from being transmitted to the microphone 221.

The power supply unit 242 may be fixed to the partition 247. In the embodiment, the power supply unit 242 is fixed to the partition 247 while being suspended in the partition 247, but is not necessarily limited thereto. In some embodiments, the power supply unit 242 may be mounted on an upper surface of the partition 247.

An inclined surface 247*a* may be formed in the bottom surface of the partition 247. The inclined surface 247*a* may have a structure substantially the same as the inclined surface 262*a* formed in the above-described room ceiling 262. The partition 27 may have a ring shape that is extended in the circumferential direction while surrounding the circumference of the power supply unit 242 when viewed vertically downward, and the inclined surface 247*a* may have a shape that becomes gradually lowered as it progresses toward the outside in the radial direction while being formed in the bottom surface of the partition 247.

The sound leaked through between the speaker 231 and the room ceiling 262 from the speaker room 260 may be blocked by the partition 247 so that it can be prevented from entering the microphone 221.

Meanwhile, the side panel 253 is formed in a cylindrical shape, and is fitted to the outside of the casing cover 252 and the casing body 251 in the state where the casing cover 252 is positioned above the casing body 251. The upper end of the side panel 253 may be positioned at substantially the same height as the upper surface of the cover upper surface portion 252*b*, and the lower end of the side panel 253 may be positioned above the sound discharge port 251*h*.

In addition, an opening may be formed in the cover upper surface portion 252*b*, and a panel 254 may be disposed inside the opening. The panel 254 may be provided with a button input unit 223.

Figure 11:
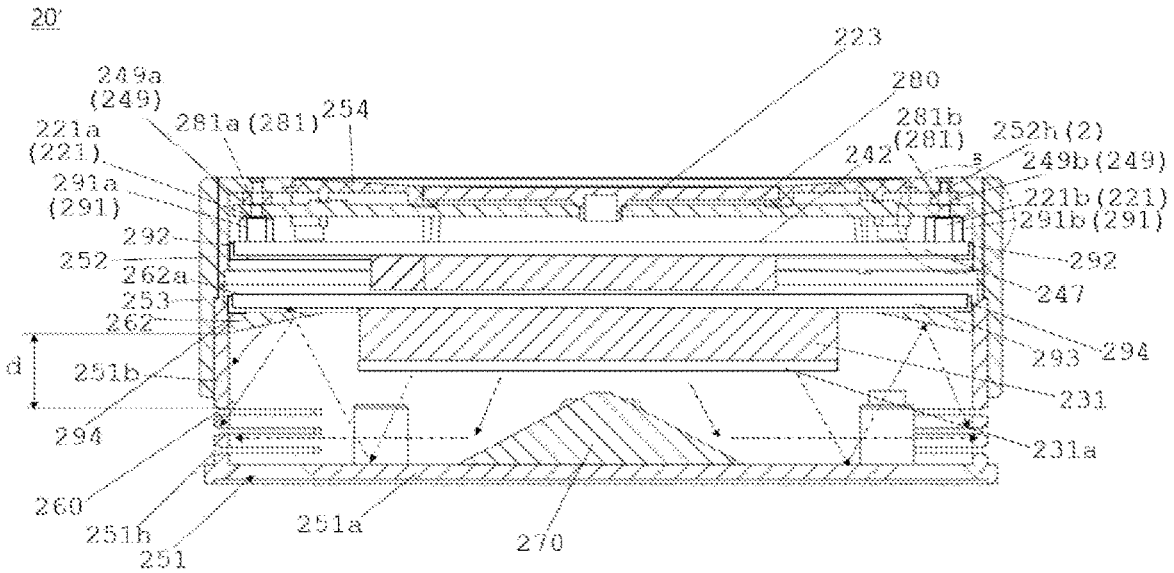
FIG. 11 is a cross-sectional view illustrating a voice input apparatus according to another embodiment of the present disclosure.

FIG. 11 is a cross-sectional view illustrating a voice input apparatus according to another embodiment of the present disclosure. Referring to FIG. 11, hereinafter, the same components as in the above-described embodiment will be denoted by the same reference numerals, and description thereof will be omitted herein.

A voice input apparatus 20' according to another embodiment of the present disclosure may include a sound insulation board 293 fixed between the speaker room 260 and the partition 247. The sound insulation board 293 may be disposed outside the speaker room 260, and preferably, above the room ceiling 262.

A fourth sealer 294 may be provided to seal between the sound insulation board 293 and the inner surface of the casing 250 (or the inner surface of the room sidewall 251*b*). The fourth sealer 294 may have an annular shape and be made of soft material to surround the circumference of the sound insulation board 293. At least a portion of the fourth sealer 294 may be interposed between the sound insulation board 243 and the inner surface of the room sidewall 251*b*. The sound transmitted from the speaker room 260 is blocked by the fourth sealer 294.

Although the exemplary embodiments of the present disclosure have been disclosed for illustrative purposes, those skilled in the art will appreciate that various modifications, additions and substitutions are possible, without departing from the scope and spirit of the disclosure as disclosed in the accompanying claims. Accordingly, the scope of the present disclosure is not construed as being limited to the described embodiments but is defined by the appended claims as well as equivalents thereto.

The invention claimed is:

1. A voice input apparatus comprising:

a panel in which a voice input hole is formed;

a circuit board which is disposed below the panel and has a voice passing hole formed in a position corresponding to the voice input hole;

a first sealer having a cylindrical shape which is disposed between the panel and the circuit board, an upper end of which is in contact with a bottom surface of the panel while surrounding the voice input hole, and a lower end of which is in contact with an upper surface of the circuit board while surrounding the voice passing hole;

a microphone which is disposed below the circuit board and has a sound receiving hole provided in a position corresponding to the voice passing hole;

a second sealer in which an accommodation space having an opening in an upper surface thereof is formed, and the microphone is disposed in the accommodation space, and which is in contact with a bottom surface of the circuit board in a state where the upper surface surrounds the voice passing hole;

a casing which is provided with a speaker room below the microphone;

a speaker which is disposed inside the speaker room;

a partition which is disposed above the speaker room inside the casing and partitions the inside of the casing vertically; and a third sealer which seals between the partition and an inner surface of the casing.

2. The voice input apparatus of claim 1, wherein the second sealer has an opening formed in a lower surface, and the lower surface is in contact with an upper surface of the partition.

3. The voice input apparatus of claim 1, further comprising:

a power supply unit which supplies power to the speaker, and is fixed to the partition.

4. The voice input apparatus of claim 3, further comprising:

a sound insulation board which is fixed between the speaker room and the partition; and a fourth sealer which seals between the sound insulation board and the inner surface of the casing.

5. The voice input apparatus of claim 3, wherein the speaker room comprises:

a room base which is disposed below the speaker; and a room sidewall which has an opened upper surface, is extended upward from a circumference of the room base to surround the speaker, and has a sound discharge port communicating the inside and the outside of the speaker room.

6. The voice input apparatus of claim 5, wherein the room side wall has an opened upper surface, and the speaker room further comprises a room ceiling covering the opened upper surface of the room sidewall.

7. The voice input apparatus of claim 5, wherein the speaker comprises a diaphragm that emits sound downward, wherein the room base is disposed below the diaphragm.

8. The voice input apparatus of claim 7, further comprising a sound guide which is protruded upward from the room base, positioned below the diaphragm, and reflects the sound outputted from the diaphragm outward in a radial direction.

9. The voice input apparatus of claim 8, wherein the sound guide has a cone shape which protrudes from the room base.

10. The voice input apparatus of claim 7, wherein the speaker room further comprises an inclined surface which is disposed in an upper side of the diaphragm and, when viewed from above, is extended in a circumferential direction while surrounding a circumference of the speaker, and is gradually lowered as it progresses toward the outside in a radial direction.

* * * * *